United States Patent [19]

Suzuki et al.

[11] 4,165,046

[45] Aug. 21, 1979

[54] DOFFING APPARATUS IN SPINNING MACHINE

[75] Inventors: Yoshihisa Suzuki, Chiryu; Shozo Ueda; Toshinori Taniguchi, both of Kariya; Keiji Onoue, Kariya, all of Japan

[73] Assignee: Kabushiki Kaisha Toyoda Jidoshokki Seisakusho, Kariya, Japan

[21] Appl. No.: 856,157

[22] Filed: Nov. 30, 1977

[51] Int. Cl.[2] ..... B65H 54/22; B65H 67/00

[52] U.S. Cl. ..... 242/35.5 A; 57/305; 242/18 R; 242/19

[58] Field of Search ..... 242/35.5 A, 35.5 R, 242/18 R, 18 DD, 18 A, 19, 41; 57/34 R, 52, 53, 54

[56] References Cited

U.S. PATENT DOCUMENTS

| | | | |
|---|---|---|---|
| 3,791,126 | 2/1974 | Kose et al. | 242/35.5 A X |
| 3,801,030 | 4/1974 | Kobatake et al. | 242/35.5 A X |
| 3,816,990 | 6/1974 | Hoffmann et al. | 242/35.5 A X |
| 3,820,730 | 6/1974 | Endo et al. | 242/35.5 A X |
| 3,915,398 | 10/1975 | Corl | 242/35.5 A |
| 3,921,921 | 11/1975 | Katayama et al. | 242/18 DD |
| 3,940,076 | 2/1976 | Kato et al. | 242/35.5 A X |
| 3,942,731 | 3/1976 | Lattion | 242/35.5 A X |
| 3,974,972 | 8/1976 | Egli et al. | 242/18 DD X |
| 4,052,017 | 10/1977 | Schar | 242/35.5 A |
| 4,069,983 | 1/1978 | Muramatsu et al. | 242/35.5 A X |

*Primary Examiner*—Stanley N. Gilreath

*Attorney, Agent, or Firm*—Wenderoth, Lind & Ponack

[57] ABSTRACT

The disclosed doffing apparatus is for use in a spinning machine including a mechanism for winding a yarn in the form of a cheese or package, a device for cutting the yarn fed to the winding mechanism when the cheese becomes full and an air suction device for sucking the cut yarn which is continuously fed even after cutting. This doffing apparatus comprises an operation member which is movably positioned in the vicinity of the air suction device and cutting device so that the operation member is operatively interconnected to the air suction device and cutting device, and opening of the air suction device and operation of the cutting device are performed by the movement of the operation member. In this doffing apparatus, release of a full cheese from the winding mechanism also can be performed by this operation member.

18 Claims, 17 Drawing Figures

DOFFING APPARATUS IN SPINNING MACHINE

BACKGROUND OF THE INVENTION

The present invention relates to a doffing apparatus for use in a spinning machine in which a yarn is wound up in the form of a cheese or a package, such as a winder, an open end spinning machine, a double twister or the like.

For convenience, the present invention will be described hereinafter by reference to embodiments in which the doffing apparatus of the present invention is applied to an open end spinning machine. The present invention, however, is not limited to such embodiments but it can be applied to any spinning machines of the foregoing types.

In general, an open end spinning machine comprises an air sucker for sucking the yarn end, a device for cutting the spun yarn and a cradle for supporting cheeses. At the doffing step, the following operations are necessary in such spinning machine. Namely, the air sucker is opened, the spun yarn is cut, the cut end of the spun yarn is sucked from a yarn end suction nozzle of the air sucker, the cradle is sprung up to separate a cheese from a winding drum, and the cheese is released from the cradle, and the thus released cheese is placed on a cheese transfer conveyor.

It is a primary object of the present invention to provide a doffing apparatus in which all or at least some of the foregoing operations necessary at the doffing step can be performed simply and assuredly by one operation member.

SUMMARY OF THE INVENTION

The foregoing and other objects and advantages of the present invention can be attained simply and assuredly by a doffing appartus comprising an operation member movably positioned in the vicinity of the abovementioned air sucker and yarn cutting device so that the operation member is operatively interconnected to the air sucker and yarn cutting device to perform at least the operations of opening the air sucker and cutting the spun yarn among the above-mentioned operations necessary at the doffing step. In addition, the operation of releasing full cheeses or packages from the cradle can be performed by the operation member.

In the doffing apparatus of the present invention, actions for performing the above-mentioned operations are very simple, and the structure of the doffing apparatus per se is very simple. Accordingly, automation of the doffing process can be accomplished very easily, and in this case, the structure of an automatic doffing machine for automatically performing the doffing process can be remarkably simplified.

In the doffing apparatus of the present invention, since a yarn guide for constraining the spun yarn at a certain position, when the operation member is moved toward the cutting device, is mounted on the operation member, a yarn being traversed can be cut precisely and surely.

Still further, in the doffing apparatus of the present invention, since the cutting device can be constructed by fixed and movable cutter blades and the movable cutter blade can be attached to the movable operation member, the structure and operation of the cutting device can be remarkably simplified and facilitated.

According to one embodiment of the doffing apparatus of the present invention, a shutter capable of sliding along the air sucker is disposed to open and close the air sucker and the shutter is engaged with the operation member, which may be rotatable. Accordingly, in this embodment, opening of the air sucker and cutting of the yarn can be accomplished merely by rotation of the operation member and hence, the operations necessary for doffing can be remarkably simplified.

According to another embodiment of the doffing apparatus of the present invention, it comprises a rotatable shaft member having a spiral groove and a portion to be engaged with such spiral groove is formed on the operation member, and the operation member is loosely fitted on the shaft member so that the shaft member is rotated by the vertical movement of the operation member, whereby opening of the air sucker and cutting of the yarn can be accomplished merely by the vertical movement of the operation member and hence, the operations necessary for doffing can similarly be simplified.

Still further, the yarn guide to be used for the abovementioned doffing apparatus of the present invention can be formed integrally with the member which is normally the operation member and to which the yarn guide is attached, and therefore, the number of parts can be decreased and the structure can be further simplified.

Moreover, in the doffing apparatus of the present invention, since a cheese supporting device to be used includes an arm extending downwardly into the moving region of the operation member, release of the cheese supporting device from the cheese by the operation member can be remarkably facilitated, and the size of the doffing apparatus per se can be diminished.

Furthermore, in the doffing apparatus of the present invention, a cheese guide is mounted on the above-mentioned cheese supporting device so that the cheese released from the cheese supporting device at the doffing step can be moved to a conveyor device of the spinning machine by the cheese guide, and therefore, the doffing operation can be accomplished more smoothly.

According to still another embodiment of the doffing apparatus of the present invention, a rotatable shaft member having a linear groove and a spiral groove is provided, and a portion to be engaged with the grooves is formed on the operation member, and the operation member is loosely fitted on the shaft member. A yarn guide for restraining the spun yarn at a certain position and an arm having the movable cutter blade, one of the two cutter blades constituting the cutting device, are fixed to the shaft member. The fixed cutter blade, i.e., the other cutter blade constituting the cutting device, is attached to the air sucker, and the shaft member is rotated when the operation member passes through the spiral groove. Namely, in this embodiment, the spun yarn is cut by rotating the arm and therefore, all the operations necessary for doffing can be accomplished merely by the vertical movement of the operation member with respect to the shaft member. Accordingly, the doffing apparatus of this embodiment is especially advantageous when the operation member is not driven manually but by mechanical means.

According to a further embodiment of the doffing apparatus of the present invention, the operation member is arranged so that it can be moved in the longitudinal direction of the spinning machine.

BRIEF DESCRIPTION OF THE DRAWINGS

Preferred embodiments of the present invention will be described in detail hereinafter by reference to the accompanying drawings, in which the same or like members or parts are represented by the same reference numerals.

Other features and advantages will be apparent from the following detailed description made by reference to the accompanying drawings, in which.

DETAILED DESCRIPTION OF THE PREFERRED EMBODIMENTS

Figure 1:
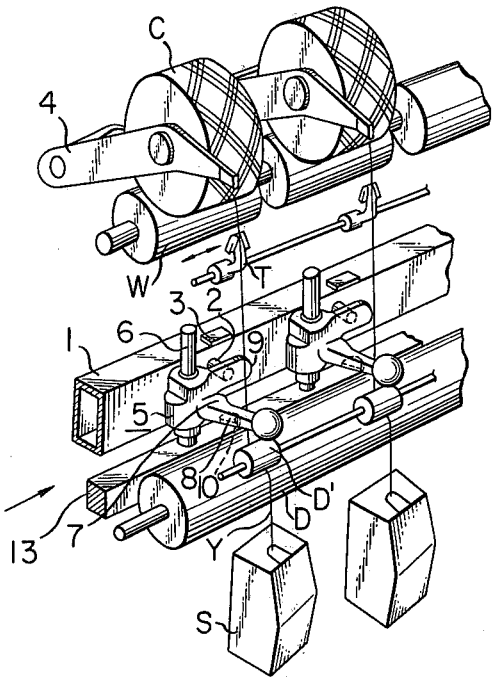
FIG. 1 is a perspective view illustrating a part of an open end spinning machine provided with one embodiment of the doffing apparatus of the present invention.

In an open end spinning machine, as shown in FIG. 1, a yarn Y spun from each spinning unit S is taken out by a pair of take-out rollers D and D', and the yarn Y is wound in the form of a cheese or package C while being traversed in the directions of the illustrated arrow by an appropriate traverse device T. The cheese C is driven by a winding drum W. An air sucker or yarn suction duct 1 is disposed along the machine stand between the winding drum W and the take-out rollers D and D' to suck and hold the yarn being spun from the spinning unit S even during the doffing operation, and a yarn suction nozzle 2 is disposed on the front side of the duct 1 in the vicinity of the run of the spun yarn Y. A cradle 4 is provided with a known pressing device (not shown) for adjustably urging the cheese C toward the winding drum W.

The above-mentioned structure of the open end spinning machine may be the same as the known structure, and therefore, further detailed explanation of the structure is omitted. In general, in the known open end spinning machine, a plurality of spinning units S as mentioned above are arranged on both sides of the machine stand. Accordingly, each of the above-mentioned devices and members should be disposed in a number corresponding to the number of the spinning units S. However, the structure need not be changed for each of these devices and members, and therefore, only two members or devices are illustrated in the drawing.

In the above-mentioned open end spinning machine, when the cheese C becomes full, the yarn suction nozzle 2 of the air sucker should be opened and, simultaneously, the yarn Y should be cut and the end of the yarn connected to the spinning unit S should be sucked into the nozzle 2. According to the conventional techniques, these operations are conducted independently from one another. According to the present invention, these operations can be performed very simply by a doffing apparatus 5.

The doffing apparatus 5 shown in FIG. 1 comprises a shaft member 6 extending upwardly from the vicinity of the associated nozzle 2, and an operation member 7 movably fitted around the shaft member 6. The shaft member 6 acts as guiding and/or supporting means for the operation member 7. The operation member 7 is arranged so that the doffing apparatus 5 may be operated very easily by a working machine (described hereinafter) for the doffing appartus or manually. Namely, the operation member 7 comprises a first arm 8 projecting from the body of the operation member 7 forwardly (toward the outside of the machine stand), a second arm 9 acting as a lid shutting the yarn suction nozzle 2, and a movable cutter blade 10 for cutting the spun yarn Y co-operatively with a fixed cutter blade 3 disposed on the top of the duct 1 to correspond to each nozzle 2. The movable cutter blade 10 is attached to the first arm 8 so that when the operation member 7 is turned as described hereinafter, the knife edge of the movable cutter blade 10 confronts the fixed cutter blade 3 to cut the yarn with the knife edge of the movable cutter blade 10. The doffing apparatus 5 may further comprise means (not shown) for fixing the operation member 7 on the shaft member 6 at a predetermined position.

The operation in the embodiment shown in FIG. 1 will now be described.

Figure 2:
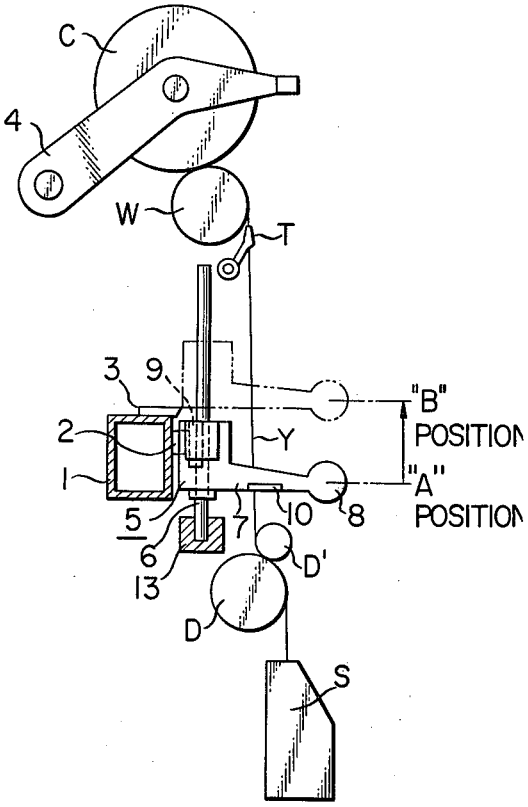
FIG. 2 is a side view as seen from the left side of FIG. 1.
Figure 3:
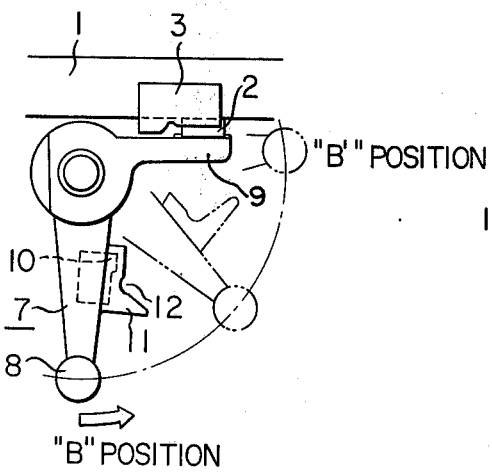
FIG. 3 is a plan view illustrating the operations of the doffing apparatus of the present invention.
Figure 4:
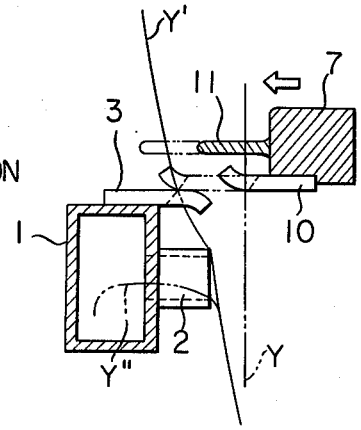
FIG. 4 is a sectional view showing passages of the yarn in various states in the doffing appartus.

At the doffing step, as shown in FIG. 2, the first arm 8 projected forwardly from the operation member 7 of the doffing apparatus 5 is lifted up along the shaft member 6 from the inoperative position A to the intermediate position B. At the position A, the second arm 9 of the operation member 7 closes the nozzle 2 of the air sucker, but if the first arm 8 is brought up to the position B from the position A along the shaft member 6, the nozzle 2 is opened. At the position B, the second arm 9 is located above the air sucker duct 1 and it does not interfere with rotation of the operation member 7 in the subsequent stage. Then, as shown in FIG. 3, the operation member 7 is rotated by a predetermined angle from the position B to the operative position B' in a direction indicated by the illustrated arrow, and the spun yarn Y is cut by the pair of cutter blades 3 and 10. The continuously spun yarn having one end cut is immediately sucked into the yarn suction nozzle 2. When the operation member 7 is rotated to the position B', the spun yarn Y is guided by a yarn guide 11 attached above the cutter blade 10 while being brought to the fixed cutter blade 3. Accordingly, cutting of the yarn can be remarkably ensured. More specifically, since the spun yarn Y before cutting is traversed by the traverse device T (see FIG. 1), the yarn guide 11 is formed to have an L- or V-shaped section including a concave portion 12 in order to constrain the running position of the yarn at the time of cutting, and during the above-mentioned rotation, the spun yarn Y is intruded into this concave portion 12 to restrain the cutting position at a cetain point in the vicinity of the yarn suction nozzle 2, whereby cutting of the yarn and suction of the cut end of the yarn can be more precisely ensured. FIG. 4 illustrates the paths of the yarn before cutting, during cuttng and after cutting. The yarn Y before cutting is pressed by the yarn guide 11 disposed on the operation member 7 to be rotated in the direction of the arrow (in this stage, the yarn Y is not engaged with the cutter blade 10), and then the yarn is caused to move into contact with the fixed cutter blade 3 and is in the cutting position which is indicated by symbol Y'. The end of the cut yarn Y" is promptly sucked into the nozzle 2 by the air suction.

In the embodiment illustrated in FIGS. 1 to 4, the shaft member 6 extends in the vertical direction but this is not an indispensable requirement. Namely, the extending direction of the shaft member 6 is not particularly critical, as long as the intended operations can be performed by the predetermined movement of the operation member 7 with respect to the shaft member 6. Of course, however, this vertical arrangement of the shaft member 6 is preferred because the action of the operation member 7 is simplified. The doffing apparatus 5 may be operated by an operator or by the working machine for operating the doffing apparatus 5. The shaft member 6 has a circular form and it is fixed to an appropriate member 13 (see FIG. 2). The shaft member 6 may have other optional shape, for example, a square sectional shape. In such case, the shaft member 6 is to be supported on the member 13 by an appropriate method so that it is turned together with the operation member 7. The yarn guide 11 may be formed integrally with the first arm 8. The positions of the fixed and movable cutter blades are not limited to those shown in the drawing and the positions of these cutter blades are not particularly critical, as long as the yarn controlled by the yarn guide 11 can be cut and the end of the cut yarn can easily be sucked into the nozzle 2.

Figure 5:
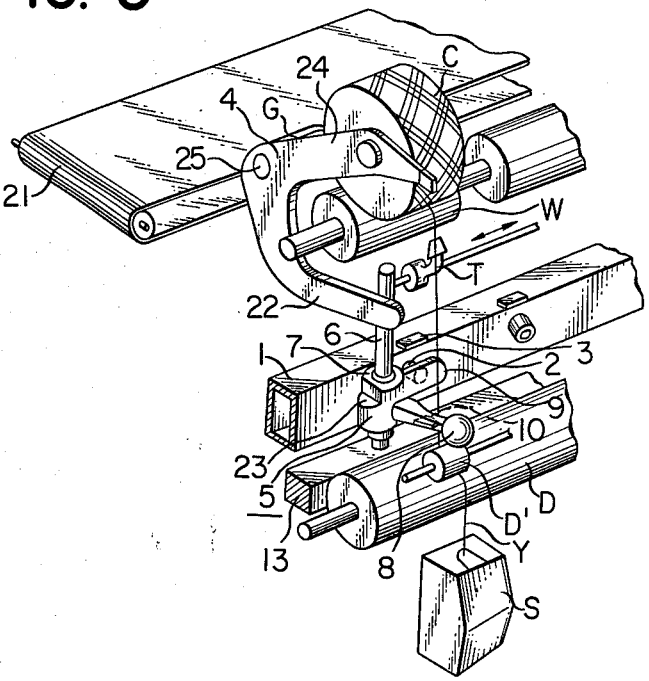
FIG. 5 is a perspective view showing a part of an open end spinning machine provided with a modification of the embodiment of the doffing apparatus shown in FIG. 1.

In the modification shown in FIG. 5, the operation of releasing cheeses from the cradle also can be accomplished by the operation member.

In the above-mentioned open end spinning machine, when the cheese C becomes full, the yarn suction nozzle 2 of the air sucker should be opened, and simultaneously, the yarn Y should be cut and the end of the yarn connected to the spinning unit S should be sucked into the nozzle 2. Then, the cheese holder 4 should be lifted up together with the cheese and separated from the winding drum W, and the cheese should then be released from the cheese holder 4 and placed on a cheese transfer conveyor 21. These operations can be performed very simply and easily with the doffing apparatus shown in FIG. 5. The operations mentioned with respect to the embodiment illustrated in FIGS. 1 to 4, of course, can be similarly accomplished.

In the modification shown in FIG. 5, the shaft member 6 has a length sufficient to guide the operation member 7 along a predetermined length so as to allow the operation member 7 to operate the cheese holder or supporting device 4. The cheese supporting device 4 has an arm 22 extending downwardly below the winding drum W into the moving region of the operation member 7, and a notch 23 to be engaged with this arm 22 is formed on the top end of the operation member 7. A cheese or package guide G is disposed between spaced cradles 24 of the cheese supporting device 4 as most typically illustrated in FIG. 6.

The operation in the modification shown in FIG. 5 will now be described.

Figure 6:
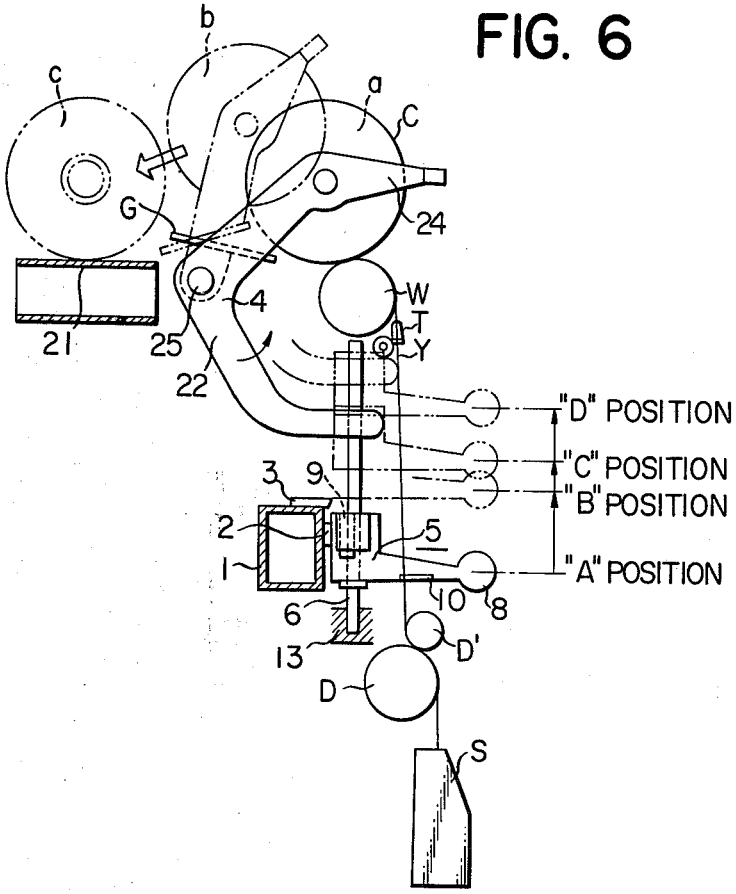
FIG. 6 is a side view as seen from the left side of FIG. 5.

At the doffing step, as shown in FIG. 6, the first arm 8 projected forwardly from the operation member 7 of the doffing apparatus 5 is lifted up along the shaft member 6 from the intermediate position A to the intermediate position B. At the position A, the second arm 9 of the operation member 7 closes the nozzle 2 of the air sucker, but if the first arm 8 is brought up to the position B from the position A along the shaft member 6, the nozzle 2 is opened. At the position B, the second arm 9 is located above the air sucker duct 1 and it does not interfere with rotation of the operation member 7 in the subsequent stage. Then, as in the embodiment shown in FIGS. 1–4, the operation member 7 is rotated by the predetermined angle from the operative position B to the position B' in a direction indicated by the arrow in FIG. 3, and the spun yarn Y is cut by the pair of the cutter blades 3 and 10. This state is shown in FIG. 3. The continuously spun yarn having one end cut is immediately sucked into the yarn suction nozzle 2. When the operation member 7 is rotated to the position B', the spun yarn Y is guided by the yarn guide 11 attached above the cutter blade 10 and brought to the other cutter blade 3 in such guided state. It is preferred that the size of the yarn guide 11 be sufficiently larger than the traverse width of the yarn at the position of the yarn guide 11. FIG. 4 also illustrates the paths of the yarn before cutting, during cutting and after cutting in the doffing apparatus of FIG. 5. The yarn Y before cutting is pressed by the yarn guide 11 disposed on the operation member 7 to be rotated in the direction of the arrow (in this stage, the yarn Y is not engaged with the cutter blade 10), and the yarn is then caused to move into contact with the fixed cutter blade 3 and is in the cutting position, which is indicated by the symbol Y'. The end of the cut yarn Y" is promptly sucked into the nozzle 2 by the air sucker.

Figure 7:
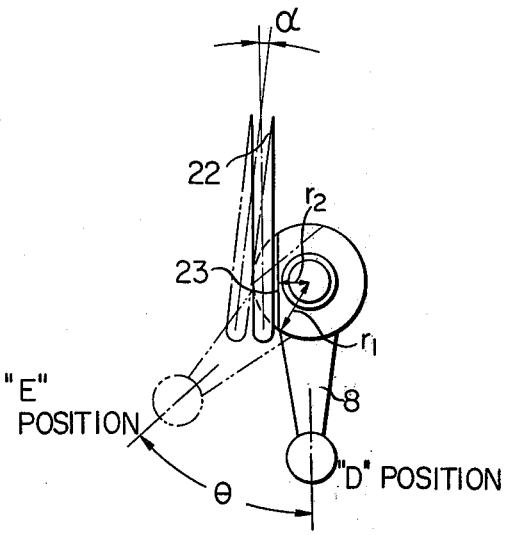
FIG. 7 is a plan view illustrating opening of a cradle by rotation of the operation member.

Then the operation member 7 is moved to the position C, and top end of the arm 22 of the cheese supporting device 4 is just moved into contact with the notch 23. While the operation member 7 is moved from the further intermediate position C to the position D, the arm 22 is continuously urged upwardly. Accordingly, the cheese supporting device 4 is rotated about a shaft 25 in the direction of an arrow the arrow in FIG. 6, with a cheese held on the cheese supporting device 4 being moved from the state a in contact with the winding drum W to the state b. At the position D, the operation member 7 is rotated in the clockwise direction (it may be rotated in the counterclockwise direction) by a prescribed angle (to further operative position E) as shown in FIG. 7, and the arm 22 fitted in a notch 23 is opened outwardly (in the direction separating it from the end face of the cheese) by an angle $\alpha$ determined by the radius difference ($r_1-r_2$) as shown in the drawing and the held cheese is released from the cradle arms. Accordingly, the cheese in the state b is allowed to fall onto the cheese guide G disposed in the cheese supporting device 4 and rolls downwardly while being guided by the cheese guide G, until the cheese is placed on the cheese transfer conveyor 21 (the state c). The conveyor 21 delivers the cheese to the end of the machine stand or to the outside of the machine stand. The cheese guide G need not indispensably be provided, but if the space of the upper part of the cradle pressing portion is appropriately modified, such guiding operation can be accomplished even without disposition of the cheese guide G. Further, it is possible to positively roll the cheese down to the conveyor by application of an external force directly applied to the cheese manually or mechanically.

After the doffing operation, an empty bobbin (not shown) is inserted between the cradle arms 24 and the arm 8 of the operation member 7 is returned by an angle $\phi$ from the position E to the position D (see FIG. 7) to hold the empty bobbin on the cradle. Then, the spun yarn which has been sucked continuously into the yarn suction nozzle 2 is wound on the empty bobbin and the first arm 8 is brought down from the position D to the position C. At this point, the cheese supporting device 4 moves about shaft 25 in the clockwise direction in FIG. 6, and the empty bobbin is pressed to the winding drum W by a known pressing mechanism (not shown) of the cheese supporting device 4. Thus, winding of the spun yarn is started again, and then, one end of the yarn sucked on the yarn end sucking nozzle 2 is cut with the hand or by optional known means and the normal winding state is restored. Thus, one cycle of the doffing operation is completed.

In the modification illustrated in FIGS. 5 to 7, the shaft member 6 also extends in the vertical direction but this is not an indispensable requirement. Namely, the extending direction of the shaft member 6 is not particularly critical as long as the intended operations can be performed by the predetermined movement of the operation member 7 with respect to the shaft member 6. Of course, however, this vertical arrangement of the shaft member 6 is preferred because the operation of the operation member 7 is simplified. The doffing apparatus 5 may be operated by an operator or by a working machine (described hereinafter) for operating the doffing apparatus 5. The shaft member 6 has a circular form and it is fixed to an appropriate member 13 (see FIG. 6). The shaft member 6 may have other optional shapes, for example, a square sectional shape. In such case, the shaft member 6 is supported on the member 13 by an appropriate method so that it is turned together with the operation member 7. The yarn guide 11 may be formed integrally with the first arm 8. The positions of the fixed and movable cutters are not limited to those shown in the drawing and the positions of these cutters are not particularly critical, as long as the yarn controlled by the yarn guide 11 can be cut and the end of the cut yarn can easily be sucked into the nozzle 2. The arm 22 of the cheese supporting device 4 need not indispensably be provided. When this arm 22 is not provided, a portion acting directly on the cradle 24 to lift it upwardly and move it outwardly is formed on the operation member 7.

Figure 8:
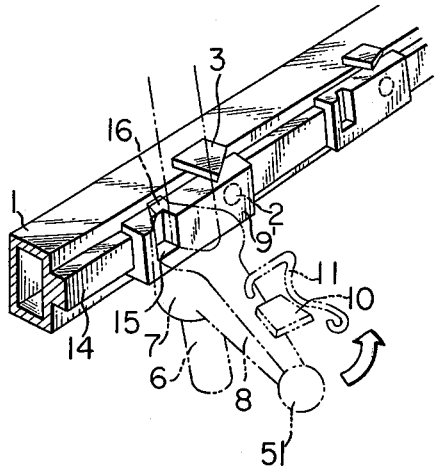
FIG. 8 is a perspective view showing another embodiment of the doffing apparatus of the present invention.
Figure 9:
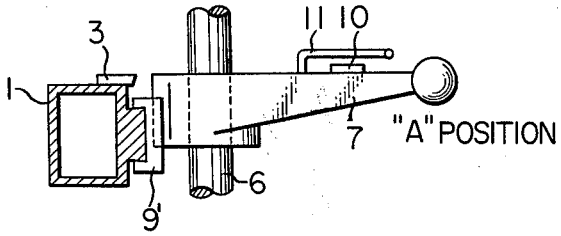
FIG. 9 is a side view showing the doffing apparatus illustrated in FIG. 8.
Figure 10:
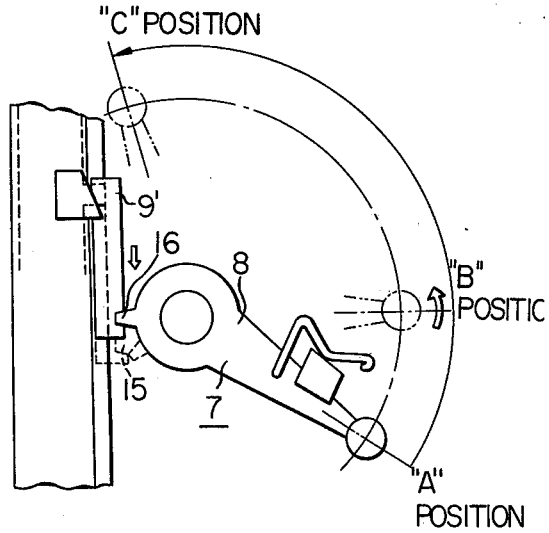
FIG. 10 is a plan view showing the doffing apparatus illustrated in FIG. 8.

Another embodiment of the present invention is illustrated in FIGS. 8 to 10. In this embodiment, opening of the air suction device and cutting of the spun yarn can be accomplished by merely rotating the operation member 7. Parts and members not particularly illustrated in FIGS. 8 to 10 are the same as the corresponding parts and members in the embodiments illustrated in FIGS. 1 to 4 and FIGS. 5 to 7. The doffing apparatus 5 comprises the shaft member 6 and the operation member 7. The shaft member 6 may be fixed or rotatable. When the shaft member 6 is fixed, the operation member 7 is rotatably supported on the shaft member 6, and when the shaft member 6 is rotatable, the operation member 7 is supported so that it can be rotated integrally with the supporting shaft 6. A guide rail 14 extends along the length of the air sucker duct 2 and a slider 9' is slidably fitted on this guide rail 14. The slider 9' acts as a lid closing the yarn end sucking nozzle 2 and therefore, it corresponds to the second arm 9 in the embodiments illustrated in FIGS. 1 to 4 and FIGS. 5 to 7. In order for the slider 9' to make a sliding movement, a notch 15 is formed on the slider 9' and a projection 16 to be engaged with this notch 15 is provided on the operation member 7. Accordingly, it is possible to open and close the yarn suction nozzle 2 by rotation of the arm 8. Further, in order to perform cutting of the yarn by rotation of the arm 8, the movable cutter blade 10 is mounted on the top face of the arm 8 so that it cuts the yarn incooperation with the fixed cutter blade 3 disposed in the vicinity of the yarn suction nozzle 2. The yarn guide 11 is attached to the arm 8 to extend before the cutter blade 10.

In the doffing apparatus illustrated in FIGS. 8 to 10, in the normal state, the operation member 7 is located at the inoperative position A shown in FIGS. 9 and 10, and at this point, the yarn end suction nozzle 2 is closed by the slider 9'. When the arm 8 is rotated in the counterclockwise direction, the slider 9' is allowed to slide in the direction indicated by an arrow in FIG. 10 and the nozzle 2 is opened. When the operation member 7 is further rotated from the intermediate position B to the operative position C, the yarn being guided by the yarn guide 11 becomes engaged with the fixed cutter blade 3 and it is gripped between the fixed cutter blade 3 and the movable cutter blade 10 and cut in this state.

In the embodiment illustrated in FIGS. 8 to 10, the guide rail 14 need not extend along the entire length of the duct 1 but it may extend along a length corresponding to the sliding region of the slider 9'. Further, the guide rail 14 need not indispensably be formed on the duct 1, but it may be formed separately from the duct 1, as long as the slider 9' sliding on the guide rail 14 can open and close the nozzle 2. Moreover, it is possible to adopt a modification in which the shaft member 6 and operation member 7 are formed so that they can be rotated integrally or a projection 16 is formed on the shaft member 6 instead of the operation member 7. Still further, it is possible to form a projection on the slider 9' and form a notch on the shaft member or operation member.

Figure 11:
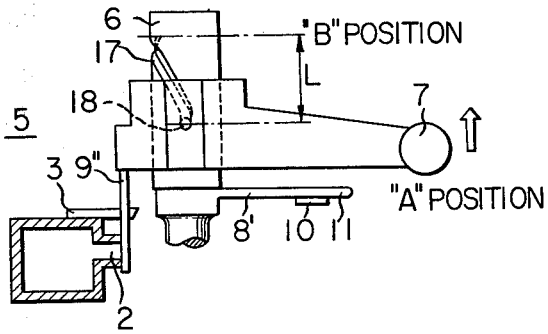
FIG. 11 is a side view illustrating still another embodiment of the doffing apparatus of the present invention.
Figure 12:
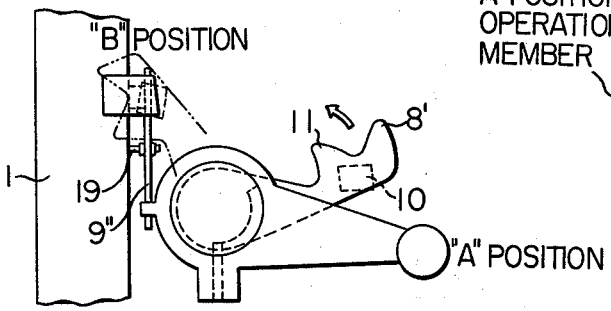
FIG. 12 is a plan view showing the doffing apparatus illustrated in FIG. 11.
Figure 13:
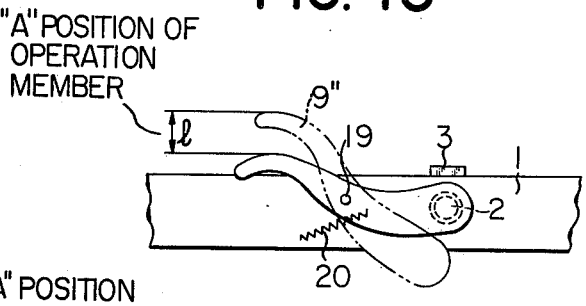
FIG. 13 is a view illustrating a shutter for opening and closing a nozzle in the doffing apparatus illustrated in FIG. 11.

Still another embodiment of the present invention is illustrated in FIGS. 11 to 13. In this embodiment, opening of the nozzle 2 and cutting of the yarn can be accomplished merely by upward movement of the operation member 7. Referring to FIG. 11, the shaft member 6 is rotatably mounted and a twisted or spiral groove 17 is formed thereon. The operation member 7 is freely fitted on the shaft member 6 and it has a pin 18 to be fitted in the groove 17. Accordingly, by upward movement of the operation member 7, the shaft member 6 is turned. In the normal state, the doffing apparatus 5 is located at the inoperative position A indicated in FIGS. 11 and 12. At this point, the nozzle 2 is closed by a lid or shutter 9'' bearing against the operation member 7. As shown in FIG. 13, the shutter 9'' is urged in the clockwise direction by a spring 20 to open the nozzle 2 and is pivoted on the duct 1 by a pin 19. Accordingly, with upward movement of the operation member 7, the shutter 9'' pivots in a clockwise direction about pin 19. The shutter 9'' is arranged so that the shutter 9'' opens the nozzle 2 completely before the pin 18 arrives at the operative position B corresponding to the yarn cutting position. An arm 8' provided with a yarn guide is integrally rotatably attached in the vicinity of the lower end of the shaft member 6. Accordingly, when the shaft member 6 is turned with upward movement of the operation member 7, the arm 8' is also turned from the normal position indicated by a solid line in FIG. 12 to the cutting position indicated by a chain line (at this point, the pin 18 is located at the position B), and the yarn is cut between the cutter blades 3 and 10. Incidentally, the relation of $l<L$ is established between the moving length L of the operation member 7 shown in FIG. 11 and the moving length l of the portion of the shutter 9'' engaged with the operation member 7 necessary for opening the nozzle 2, which is illustrated in FIG. 13.

Figure 14:
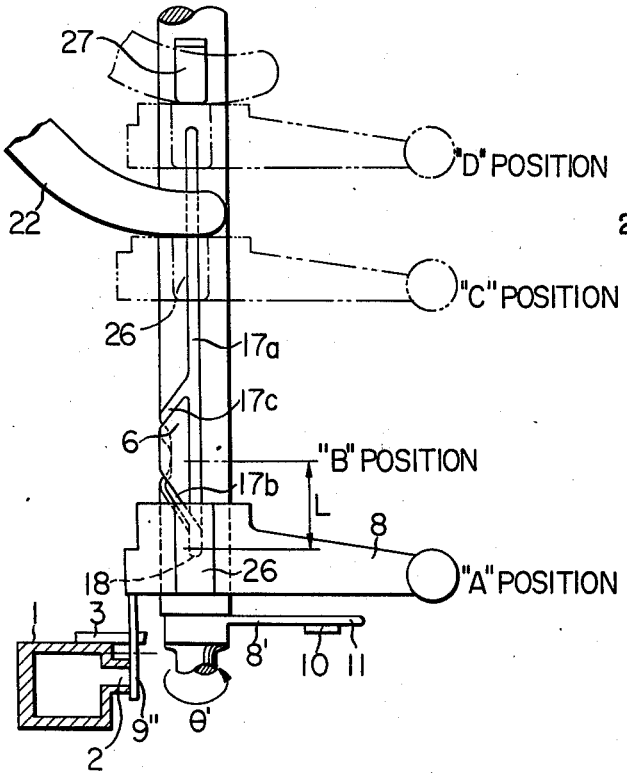
FIG. 14 is a side view illustrating a modification of the embodiment of the doffing apparatus shown in FIG. 11.
Figure 15:
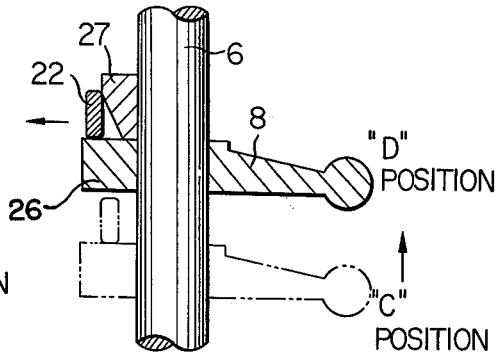
FIG. 15 is a sectional view illustrating opening of a cradle arm in the doffing apparatus shown in FIG. 14.

A modification of the embodiment of FIG. 11 is illustrated in FIGS. 14 and 15. In this embodiment, opening of the nozzle 2, cutting of the yarn and lifting and opening of the cradle can be accomplished merely by upward movement of the operation member 7.

Referring to FIG. 14, the shaft member 6 is rotatably mounted and has a linear groove **17*a* and a spiral groove 17*b*. The operation member 7 is loosely fitted on the shaft member 6 and it has a pin 18 to be fitted in the groove 17*a* or 17*b*. Accordingly, by upwardly moving the operation member 7 so that the pin 18 passes through the spiral groove 17*b*, the shaft member 6 is turned. In the normal state, the doffing apparatus 5 is located at the position A indicated in FIGS. 12 and 14. At this point, the nozzle 2 is closed by a lid or shutter 9'' bearing against the lower edge of the operation member 7. As shown in FIGS. 12 and 13, the shutter 9'' is urged in the direction opening the nozzle 2 by a spring 20 and is pivoted on the duct 1 by a pin 19. Accordingly, with upward movement of the operation member 7, the shutter 9'' pivoted about pin 19. The shutter 9'' is arranged so that the shutter 9'' opens the nozzle 2 completely before the pin 18 arrives at the position B corresponding to the yarn cutting position. An arm 8' provided with a yarn guide is integrally rotatably attached in the vicinity of the lower end of the shaft member 6. Accordingly, when the shaft member 6 is turned with upward movement of the operation member 7, the arm 8' is also turned by an angle $\theta'$ from the normal position indicated by a solid line in FIG. 12 to the cutting position indicated by a chain line (at this point, the pin 18 is located at the position B), and the yarn is cut between the cutter blades 3 and 10. Incidentally, the relation of $l<L$ is established between the moving length L of the operation member 7 shown in FIG. 14 and the moving length l of the portion of the shutter 9'' engaged with the operation member 7 necessary for opening the nozzle 2, which is illustrated in FIG. 13**.

In FIG. 14, the operation member 7 is then moved from the position B to the position C through a reverse spiral groove **17*c* and the linear groove 17*a*. While the operation member 7 passes through the reverse spiral groove 17*c*, the shaft member 6 is turned in the reverse direction and the arm 8' is returned to the original position. When the operation member 7 arrives at the position C, the arm 22 is in contact with a lateral projection 26 formed on the operation member 7. When the operation member 7 is further moved upwardly, the cradle as shown in FIG. 6 is pivoted upwardly by the arm 22, and when the arm 22 becomes engaged with an inclined cam 27 mounted on the shaft member 6, the cradle is outwardly opened as indicated by an arrow in FIG. 15 and opening of the cradle is completed when the operation member 7 is located at the position D. Accordingly, as illustrated hereinbefore with respect to the embodiment shown in FIGS. 5 to 7, the cheese is placed on the conveyor 21. After the doffing operation, by lowering the operation member 7 from the position D to the position C, holding of an empty bobbin and pressing of the empty bobbin to the winding drum W are accomplished, and when the operation member 7 is lowered from the position C to the position A only through the linear groove 17*a*, the doffing apparatus is restored to the state before doffing. Operations of winding the yarn on the empty bobbin, cutting the yarn sucked into the nozzle 2 and other operations are performed according to the same procedures as described hereinbefore with respect to the embodiment shown in FIGS. 5 to 7**.

Figure 16:
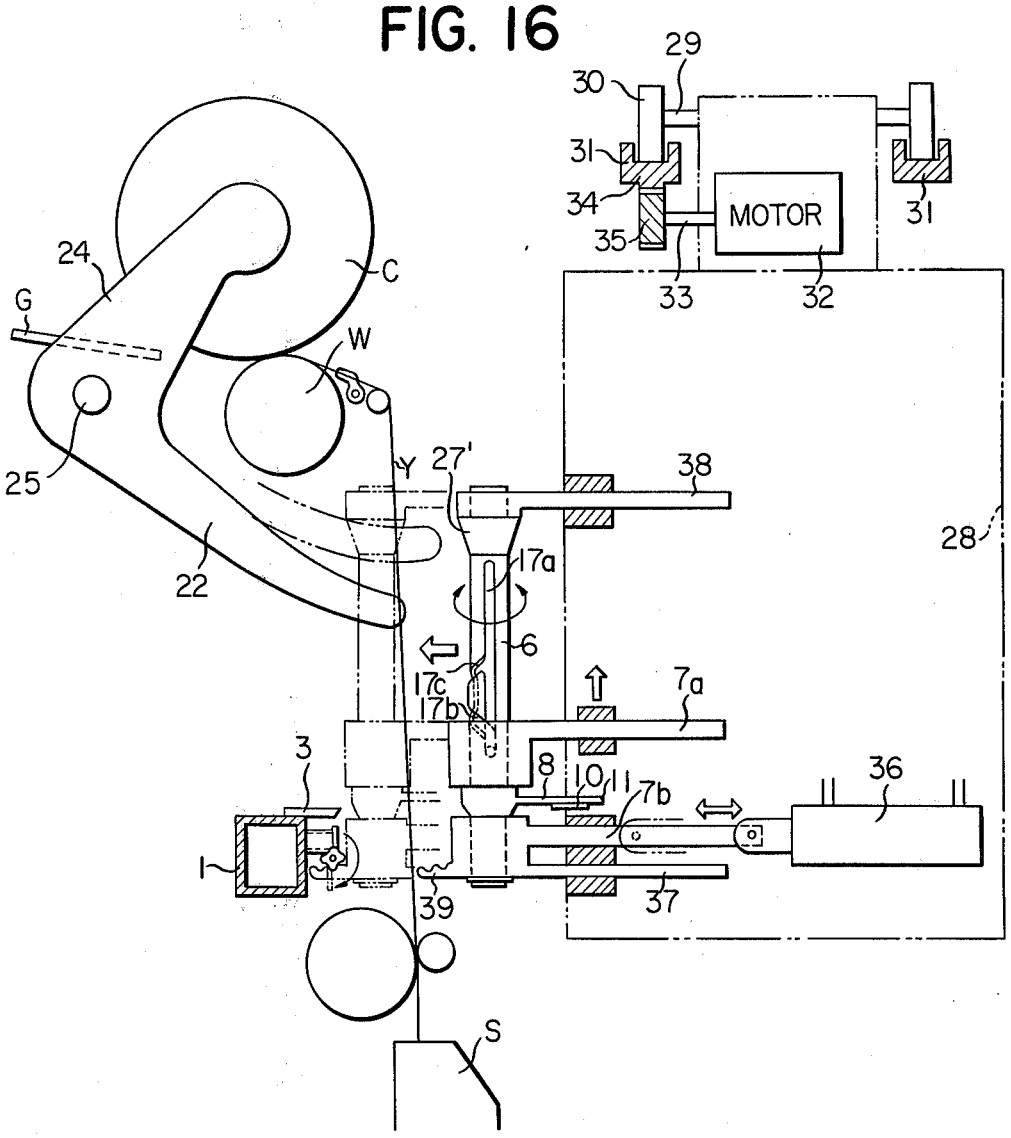
FIG. 16 is a partially sectional side view showing a moving type doffing apparatus according to the present invention.
Figure 17:
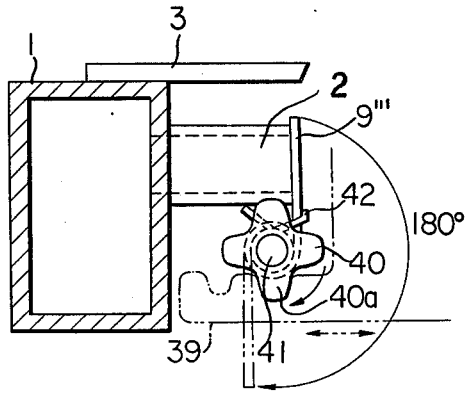
FIG. 17 is an enlarged view showing a mechanism for opening and closing a nozzle in the doffing apparatus shown in FIG. 16.

A further embodiment of the present invention is illustrated in FIGS. 16 and 17, in which a moving tupe doffing apparatus is employed. The shaft member 6 is substantially the same as the shaft member 6 shown in FIG. 14, and the operation member 7 comprises a first operation member **7*a* and a second operation member 7*b*. The shaft member 6 is attached to a housing 28 through the first and second operation members 7*a* and 7*b*. A shaft 29 is mounted in the upper portion of the housing 28 and guide rollers 30 disposed on both ends of the shaft 29 are engaged with rails 31 extending along the machine stand of the spinning machine to support the housing 28. In order to move the housing 28, a pinion 35 to be engaged with a rack 34 disposed on the lower face of one rail 31 is attached to an output shaft 33 of a motor 32 mounted in the housing 28. Accordingly, when the motor 32 is rotated, by the driving force of the motor 32 the housing 28 is moved along the machine stand together with the shaft member 6 and the operation members 7*a* and 7*b*. A plurality of the shaft members and a plurality of the operation members may be disposed in the doffing apparatus of the present embodiment, and cheeses corresponding in number to that of these members can be doffed at one time. The shaft member 6 and the operation members 7*a* and 7*b* are advanced and retreated between the retreated non-operating position indicated by solid lines in FIG. 16 and the advanced operating position indicated by the chain lines so that while the doffing apparatus is moved along the machine stand, these members 6, 7*a* and 7*b* do not interfere with parts of the spinning machine or spun yarns. The retreating movement of these members 6, 7*a* and 7*b* is accomplished by an optional actuating device 36 (solenoid in the embodiment illustrated in the drawing) which is connected to the other end of the second operation member 7*b* having one end fitted in the shaft member 6. In addition to the solenoid, the combination of a rack and a pinion, a combination of a screw shaft and a nut, or the like can be employed as the actuating device 36. Guide rods 37 and 38 extending into the housing 28 from the second operation member 7*b* and a cradle opening cam 27'** are disposed to guide the shaft member 6 being retreated or advanced. These guide members are not indispensable but they may be disposed according to need. The vertical movement of the first operation member 7a is performed by a device similar to the actuating device 36. Accordingly, explanation of this device is omitted. A rack 39 is mounted on the top end of the second operation member 7b and a pinion 40 is disposed in the vicinity of the yarn end suction nozzle 2 so that opening of the air sucker duct 1 can be accomplished by advancing movement of the shaft member 6. The pinion 40 and a shutter 9''' of the nozzle 2 are attached to a pin 41 so that they are integrally turned. A spring 42 is attached to the pin 41 and is interposed between the nozzle wall and the shutter 9''' so that the shutter 9''' is normally urged to the nozzle-closing position shown in FIG. 17. As shown in the drawing, the teeth of the pinion 40 are large in size, and when the nozzle 2 is in the closed state, the teeth 40a of the pinion 40 on the side of the rack 39 have tips directed downwardly. Accordingly, the pinion 40 is readily in engagement with the rack 39 moved by the actuating device 36. The opening and closing angle of the shutter 9''' is adjusted so that it can turn by about 180° so as not to interfere with the yarn cutting operation.

The operation of the doffing apparatus shown in FIGS. 16 and 17 will now be described.

The doffing apparatus is driven by the motor 32 to move on the front face of the machine stand. When the doffing apparatus stops in front of a cheese to be doffed, the actuating device 36 is urged to shift the shaft member 6, the first and second operation members 7a and 7b, the arm 8 and the cradle opening cam 27' from the retreated non-operating position indicated by solid lines to the advanced operating position indicated by chain lines. At this shifting operation, the rack 39 mounted on the top end of the second operation member 7b is engaged with the pinion 40, and the pinion 40 and shutter 9''' are turned by about 180° to open the air sucker. Then, the operation member 7a which is freely fitted in the operation shaft member 6 having grooves 17a, 17b and 17c and is provided with a pin 18 to be engaged with the grooves is moved upwardly by the above-mentioned actuating device. Operations of other related members with the upward movement of the operation member 7a are the same as those described hereinabove with respect to the embodiment illustrated in FIGS. 14 and 15. Thus, one cycle on the doffing operation is completed. A series of these operations for doffing of cheeses can be performed by using an appropriate program mechanism as adopted in the known doffing apparatuses. Further, supply of empty bobbins may be appropriately performed manually or automatically according to known procedures.

Those skilled in the art will readily modify the doffing apparatuses illustrated in the embodiments shown in FIGS. 1 to 15 to moving types. In accordance with the invention, one doffing apparatus may be provided for each spinning unit, or one or a plurality of doffing apparatuses may be provided for movement along the spinning machine so that a single doffing apparatus is commonly used for a plurality of spinning units.

The present invention has been illustrated by reference to several embodiments. Various modifications will be made to these embodiments without departing from the scope and spirit of the present invention. For example, vertical movement of the operation member may be carried out by a winding mechanism which includes a wire fixedly attached to the operation member to lower and raise the same upon actuation of the winding mechanism.

What is claimed is:

1. In a spinning machine of the type including a spinning unit for spinning yarn, winding means for winding said yarn into a package, cutting means for cutting said yarn when a package is wound, and suction means positioned adjacent the position of cutting of said yarn for grasping the free end of the spun yarn upon the cutting of said yarn, the improvement comprising:

an operating member positioned adjacent said suction means, said operating member being mounted for movement between an inoperative position and an operative position;

said cutting means comprising a fixed cutter blade fixedly positioned at said cutting position and a movable cutter blade connected to said operating member in a manner such that movement of said operating member to said operative position thereof moves said movable cutter blade into cooperation with said fixed cutter blade to cut said yarn; and means for closing said suction means when said operating member is in said inoperative position thereof and operable by movement of said operating member toward said operative position thereof for opening said suction means such that said free end of the spun yarn can be grasped by said suction means upon the cutting of said yarn by said cutting means.

2. The improvement claimed in claim 1, further comprising yarn guide means mounted adjacent and movable with said movable cutter blade for guiding said yarn to said fixed cutter blade when said operating member is moved to said operative position thereof.

3. The improvement claimed in claim 2, wherein said yarn guide means and said movable cutter blade are integrally and fixedly joined to said operating member.

4. The improvement claimed in claim 1, further comprising a shaft member, said operating member being mounted on said shaft member.

5. The improvement claimed in claim 4, wherein said operating member is rotatably mounted about said shaft member.

6. The improvement claimed in claim 5, wherein said operating member is movable axially of said shaft member from said inoperative position thereof to an intermediate position, said operating member is movable rotatably of said shaft member from said intermediate position to said operative position, said suction closing and opening means comprises an arm integral with said operating member and extending therefrom at a position to cover said suction means when said operating member is in said inoperative position and to uncover said suction means when said operating member is in said intermediate position, and said fixed cutter blade is fixed to said operating member and is movable during rotatable movement thereof to cooperate with said fixed cutter blade.

7. The improvement claimed in claim 5, wherein said operating member is rotatably movable about said shaft member from said inoperative to said operative positions thereof, said suction means comprises a suction body having a suction nozzle, said suction closing and opening means comprises a slidable shutter mounted on said suction body and slidable thereon between a first position closing said nozzle and a second position opening said nozzle, said operating member having means for engaging said shutter during rotatable movement of said operating member about said shaft member between said inoperative position thereof and an intermediate position and for thereby sliding said shutter between said first and second positions thereof, and said fixed cutter blade is fixed to said operating member and is movable during rotatable movement thereof to cooperate with said fixed cutter blade.

8. The improvement claimed in claim 5, wherein said shaft member has a spiral groove therein, said operating member includes means for engaging in said spiral groove, said operating member is movable between said inoperative and operative positions thereof axially of said shaft member only, such that engagement of said engaging means in said spiral groove causes rotary movement of said shaft member, said movable cutter blade is fixed to said shaft member and is rotatable therewith to cooperate with said fixed cutter blade, and said suction closing and opening means comprises a shutter pivotally mounted between a first position covering said suction means and a second position uncovering said suction means, and spring means for urging said shutter to pivot to said second position thereof, said operating member when in said inoperative position thereof contacting said shutter and pivoting said shutter to said first position thereof against the force of said spring means.

9. The improvement claimed in claim 1, wherein said winding means includes means for supporting a package of yarn during the winding thereof, said operating member is movable to a further operative position, and further comprising means for releasing said yarn package from said supporting means upon movement of said operating member to said further operative position thereof.

10. The improvement claimed in claim 9, further comprising a shaft member, said operating member being mounted on said shaft member.

11. The improvement claimed in claim 10, wherein said operating member is rotatably mounted about said shaft member.

12. The improvement claimed in claim 11, wherein said operating member is movable axially of said shaft member from said inoperative position thereof to an intermediate position, said operating member is movable rotatably of said shaft member from said intermediate position to said operative position, said suction closing and opening means comprises an arm integral with said operating member and extending therefrom at a position to cover said suction means when said operating member is in said inoperative position and to uncover said suction means when said operating member is in said intermediate position, said movable cutter blade is fixed to said operating member and is movable during rotatable movement thereof to cooperate with said fixed cutter blade, said supporting means is pivotally mounted and includes a yarn package supporting arm extending therefrom, said operating member is further axially movable of said shaft member from said intermediate position thereof to a further intermediate position thereof whereat said supporting means is contacted by said operating member and pivoted thereby away from a normal winding position, said operating member is movable rotatably of said shaft member from said further intermediate position to said further operative position, and means on said operating member for moving said supporting arm away from said yarn package upon movement of said operating member to said further operative position and for thereby allowing said yarn package to freely drop away from said supporting means.

13. The improvement claimed in claim 12, wherein said supporting means further comprises package guide means for guiding a yarn package which has dropped away from said supporting means to a removal conveyor.

14. The improvement claimed in claim 9, wherein said releasing means comprises means for pivotally mounting said supporting means, said supporting means including a yarn package supporting arm extending therefrom, said operating member being movable in a first direction to contact said supporting arm and to pivot said supporting means and said yarn package away from a normal winding position, and said operating member being movable in a second direction to said further operative position to contact said supporting arm and to move said supporting arm away from said yarn package and thereby allow said yarn package to freely drop away from said supporting means.

15. The improvement claimed in claim 9, further comprising a shaft member having therein an axial groove and a spiral groove, said operating member being mounted about said shaft member, said operating member including means for engaging in said grooves, said operating member being movable axially of said shaft member only, said engaging means being in said spiral groove during axial movement of said shaft from said inoperative to said operative positions thereof and thus causing rotary movement of said shaft member, said movable cutter blade being fixed to said shaft member and rotatable therewith to cooperate with said fixed cutter blade, said suction closing and opening means comprising a shutter pivotally mounted between a first position covering said suction means and a second position uncovering said suction means, and spring means for urging said shutter to pivot to said second position thereof, said operating member when in said inoperative position thereof contacting said shutter and pivoting said shutter to said first position thereof against the force of said spring means, said engaging means being in said axial groove during axial movement of said operating member to said further operative position, said releasing means comprising means for pivotally mounting said supporting means, said supporting means including a yarn package supporting arm extending therefrom, said operating member contacting said supporting arm to pivot said supporting means and said yarn package away from a normal winding position when said operating member is moved to said further operative position, and cam means on said shaft member for, when said operating member is moved to said further inoperative position thereof, moving said supporting arm away from said yarn package and for thereby allowing said yarn package to drop away from said supporting means.

16. In a spinning machine of the type including a plurality of winding units, each said winding unit comprising a spinning unit for spinning yarn, winding means for winding said yarn into a package and including means for supporting a package of yarn during the winding thereof, and fixed cutter blade means for cutting said yarn when a package is formed, the improvement comprising:

a single operating member;

means for moving said operating member along said winding units to a location aligned with a selected one of said winding units;

means for moving said operating member between an inoperative position, a first operative position, and a second operative position;

movable cutter blade means connected to said operating member in a manner such that movement of said operating member to said first operative position thereof moves said movable cutter blade means into cooperation with said fixed cutter blade means of said selected winding unit to cut said yarn thereof; and means for releasing said yarn from said supporting means of said selected winding unit upon movement of said operating member to said second operative position thereof.

17. The improvement claimed in claim 16, wherein each said winding unit further includes suction means positioned adjacent the position of cutting of said yarn for grasping the free end of the spun yarn upon cutting of said yarn, and shutter means normally closing said suction means; and further comprising means for moving said operating member from a first selected position spaced from said selected winding unit to a second selected position adjacent said selected winding unit, and means connected to said operating member for moving said shutter means to open and close said suction means upon movement of said operating member to and away from said second selected position thereof, respectively.

18. The improvement claimed in claim 16, further comprising a shaft member having therein an axial groove and a spiral groove, said operating member being mounted about said shaft member, said operating member including means for engaging in said grooves, said operating member being movable axially of said shaft member only, said engaging means being in said spiral groove during axial movement of said shaft from said inoperative to said first operative positions thereof and thus causing rotary movement of said shaft member, said movable cutter blade means being fixed to said shaft member and rotatable therewith to cooperate with said fixed cutter blade means, said engaging means being in said axial groove during axial movement of said operating member to said second operative position, said releasing means comprising means for pivotally mounting said supporting means, said supporting means including a yarn package supporting arm extending therefrom, said operating member contacting said supporting arm to pivot said supporting means and said yarn package away from a normal winding position when said operating member is moved to said second operative position, and cam means on said shaft member for, when said operating member is moved to said second operative position thereof, moving said supporting arm away from said yarn package and for thereby allowing said yarn package to drop away from said supporting means.

* * * * *